US007963731B2

(12) United States Patent
Baker et al.

(10) Patent No.: US 7,963,731 B2
(45) Date of Patent: Jun. 21, 2011

(54) THERMOFORMED SEPARATOR PAD

(75) Inventors: Paul W. Baker, Cambridge, OH (US); Thomas M. Quinn, New Concord, OH (US); Terence W. Staed, St. Louis, MO (US); Richard H. Lee, St. Louis, MO (US)

(73) Assignee: The Fabri-Form Company, New Concord, OH (US)

( * ) Notice: Subject to any disclaimer, the term of this patent is extended or adjusted under 35 U.S.C. 154(b) by 901 days.

(21) Appl. No.: 11/825,877

(22) Filed: Jul. 10, 2007

(65) Prior Publication Data

US 2009/0016837 A1 Jan. 15, 2009

(51) Int. Cl.
*B60P 7/00* (2006.01)

(52) U.S. Cl. ..... 410/155; 410/40; 410/99

(58) Field of Classification Search ..... 410/35, 410/39, 46, 41, 99, 40, 118, 120, 154, 155; 108/57.17, 57.18, 57.26, 57.27, 57.25, 57.28, 108/53.3, 901; 206/453, 516, 586, 593, 594; 248/345.1, 633

See application file for complete search history.

(56) References Cited

U.S. PATENT DOCUMENTS

| | | | | |
|---|---|---|---|---|
| 2,713,485 | A * | 7/1955 | Tillou | |
| 3,199,469 | A * | 8/1965 | Sullivan | |
| 5,558,222 | A | 9/1996 | Volk et al. | 206/338 |
| 5,894,804 | A | 4/1999 | Werner | 108/53.5 |
| 5,993,936 | A | 11/1999 | Gardner | 428/131 |
| 6,718,887 | B1 | 4/2004 | Cook, Sr. | 108/53.3 |
| 7,677,849 | B2 * | 3/2010 | Scott | 410/99 |

FOREIGN PATENT DOCUMENTS

| | | |
|---|---|---|
| DE | AT 339 198 | 10/1977 |
| WO | WO 00/24636 | 4/2000 |

OTHER PUBLICATIONS

European Search Report in corresponding European application (Oct. 23, 2008—6 pages).

* cited by examiner

*Primary Examiner* — Stephen Gordon
(74) *Attorney, Agent, or Firm* — Renner, Kenner, Greive, Bobak, Taylor & Weber

(57) ABSTRACT

A pad (20) is particularly suited for separating or restraining cargo and includes a top sheet surface (21) having longitudinally extending spaced ribs (27) forming a plurality of recesses (28) therebetween. A pattern of lugs (31) is formed in the recesses (28). The pad (20) also includes a bottom sheet surface (22) having longitudinally extending spaced ribs (29) forming a plurality of recesses (30) therebetween. A pattern of notches (32) is formed in the ribs (29), and the pad (20) may nest with a like pad (20) by placing the lugs (31) in the notches (32). The pads (20) may stack to form a thicker pad by positioning the ribs (27) of one pad (20) in the recesses (28) of a like pad (20). A flange (33) extends outwardly from one of the edges of the sheet surface (21) which assists in preventing the pad (20) from sliding when in use.

7 Claims, 9 Drawing Sheets

THERMOFORMED SEPARATOR PAD

TECHNICAL FIELD

The invention relates to a thermoformed twin sheet material which is used as a pad to protect, restrain, and/or separate loads in a transportation device such as a truck, railcar, or the like.

BACKGROUND ART

Separating and restraining devices are often utilized in cargo carriers such as a truck, railcar, or the like. These devices can be used if dissimilar loads are to be separated from each other or can be used to prevent a load from moving or shifting in the carrier. Oftentimes, items that are extremely heavy cannot be loaded completely from the front to back and bottom to top of the truck because the load would exceed the maximum allowable weight that could be carried. As a result, bulkhead spacers may be utilized to create dead space in the truck, and a separating device is positioned against such spacers to restrain the load and prevent it from shifting into the dead space.

Typically, wood, airbag, corrugated and/or paper spacers have to be used which are not only heavy and/or expensive, but which are also difficult to transport and, therefore, are not reused, but are rather discarded after one use. Thus, the need exists for a device which can be used to separate and/or protect loads which is light weight, easy to install, easy to clean, easy to transport, and reusable, and yet strong enough to perform its desired function.

DISCLOSURE OF THE INVENTION

It is thus an object of one aspect of the present invention to provide a lightweight but strong pad for separating and restraining a cargo load.

It is an object of another aspect of the invention to provide a pad, as above, which in one position is nestable with a like pad thereby rendering a plurality of pads convenient to transport and to maximize load stack quantity during transport to the user and return.

It is an object of a further aspect of the invention to provide a pad, as above, which in another position is not nestable with a like pad thereby filling more space and creating more strength than a single pad, if that would be desired.

It is an object of an additional aspect of the invention to provide a pad, as above, with a side flange which will prevent sliding and will protect cargo from compression restraint damage.

It is an object of yet another aspect of the invention to provide a pad, as above, which can be provided with feet to prevent skidding during shipment from the factory to the user or during the return of the pads for reuse.

It is an object of still another aspect of the invention to provide a pad, as above, with a handle for ease of carrying and maneuvering.

These and other objects of the present invention, as well as the advantages thereof over existing prior art forms, which will become apparent from the description to follow, are accomplished by the improvements hereinafter described and claimed.

In general, a pad made in accordance with one aspect of the present invention includes a first sheet surface and a second sheet surface opposed to the first sheet surface. The surfaces have opposed longitudinally extending edges and opposed laterally extending edges. A flange extends generally laterally outward from only one of the longitudinally extending edges of the first sheet surface.

In accordance with another aspect of the invention, the pad includes a first sheet surface and a second sheet surface opposed to the first sheet surface. A pattern of lugs is formed on the first sheet surface and a like pattern of notches is formed on the second sheet surface such that in one orientation a pad may nest with a like pad by positioning the lugs of the pad in the notches of the like pad. By changing the orientation of the pad relative to the like pad, the pad and the like pad will not nest.

According to another aspect of the invention, the pad includes a first sheet surface and a second sheet surface opposed to the first sheet surface. The surfaces have opposed longitudinally extending edges and opposed laterally extending edges. A flange extends generally laterally outward from only one of the longitudinally extending edges of the first sheet surface. A pattern of lugs is formed on the first sheet surface and a like pattern of notches is formed on the second sheet surface such that in one orientation a pad may nest with a like pad by positioning the lugs of the pad in the notches of the like pad. By changing the orientation of the pad relative to the like pad, the pad and the like pad will not nest.

A preferred exemplary separator pad according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
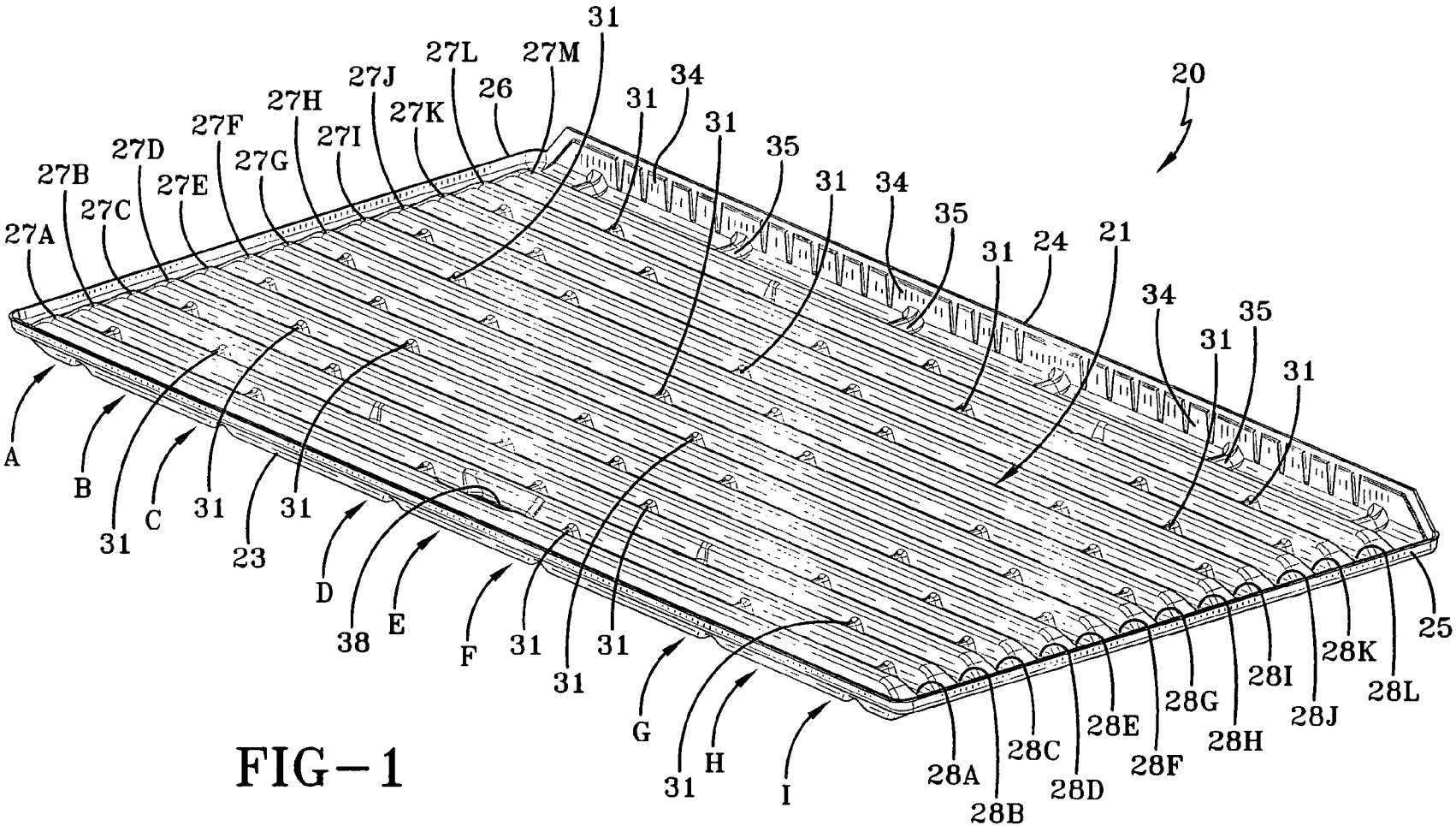
FIG. 1 is a perspective view of one surface of a separator pad made in accordance with the present invention.
Figure 2:
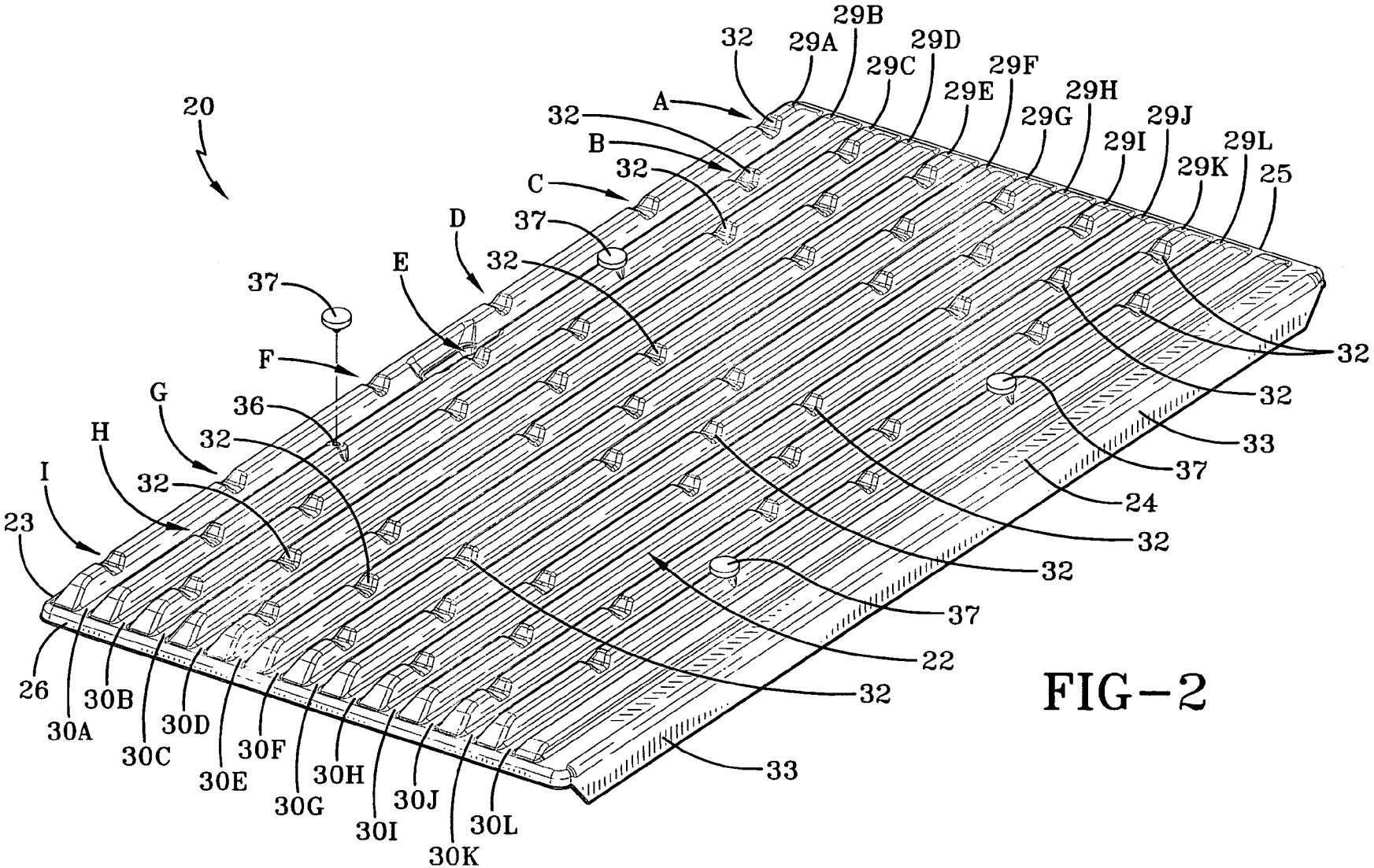
FIG. 2 is a perspective view of the other surface of the separator pad and showing a rubber foot being inserted into the pad.

A separator pad made in accordance with the present invention is indicated generally by the numeral 20 and is preferably thermoformed from a high density polyethylene or like material. Pad 20 is configured as longitudinally extending twin sheets of material having a top sheet surface generally indicated by the numeral 21 and a bottom sheet surface generally indicated by the numeral 22. Surfaces 21 and 22 are defined by longitudinally extending, laterally spaced, side edges 23, 24 and by laterally extending longitudinal spaced, end edges 25, 26. Edges 23, 25, and 26 may be provided with an upstanding lip as shown.

Sheet surface 21 is provided with a plurality of longitudinally extending, spaced, raised ribs 27 defining longitudinally extending recesses 28 therebetween. As shown there are thirteen ribs 27A-M and thus twelve recesses 28A-L on surface 21. Sheet surface 22 is likewise provided with a plurality of longitudinally extending, spaced, raised ribs 29 defining longitudinally extending recesses 30 therebetween. Like ribs 27A-M and recesses 28A-L, there are thirteen ribs 29A-M and twelve recesses 30A-L. Ribs 29A-M are thus laterally aligned with ribs 27A-M respectively, and recesses 30 A-L are thus laterally aligned with recesses 28A-L respectively. This pattern of ribs and recesses allows pad 20 to be made of very thin material, approximately 0.2 inches thick, and yet be very strong being able to withstand bending loads of six hundred pounds.

Figure 3:
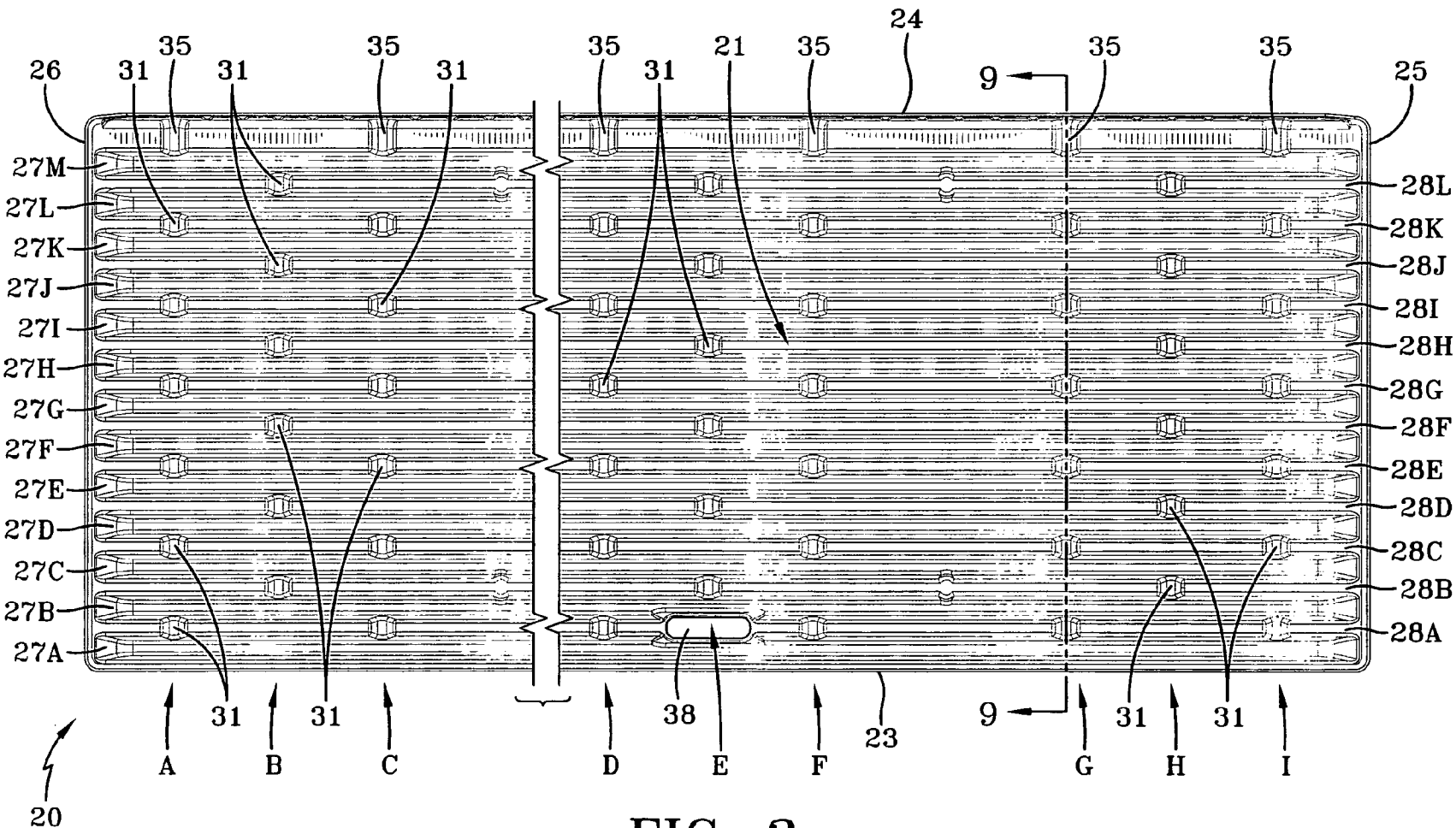
FIG. 3 is an elevational view of the surface of the separator pad shown in FIG. 1.

Sheet surface 21 also includes nine longitudinally spaced rows A-I of lugs 31 which are positioned in recesses 28 and which extend between adjacent ribs 27. Each row A-I includes six lugs 31 and the lugs are grouped in clusters of three rows each, rows A-C, rows D-F, and rows G-I. As best seen in FIG. 3, each cluster of rows includes an identical pattern of lugs 31. Thus, in the A-C cluster of rows, in rows A and C lugs 31 are aligned in alternate recesses 28A, 28C, 28E, 28G, 28I, and 28K. In row B, lugs 31 are staggered from those in rows A and C and thus are aligned in alternate recesses 28B, 28D, 28F, 28H, 28J, and 28L. In the D-F cluster of rows, in rows D and F, lugs 31 are aligned in alternate recesses 28A, 28C, 28E, 28G, 28I, and 28K and in row E, lugs 31 are staggered from those rows D and F and thus are aligned in alternate recesses 28B, 28D, 28F, 28H, 28J, and 28L. Similarly, in the G-I cluster of rows, in rows G and I lugs 31 are aligned in alternate recesses 28A, 28C, 28E, 28G, 28I, and 28K and in row H, lugs 31 are staggered from those in rows G and I and are thus aligned in alternate recesses 28B, 28D, 28F, 28H, 28J, and 28L.

Figure 4:
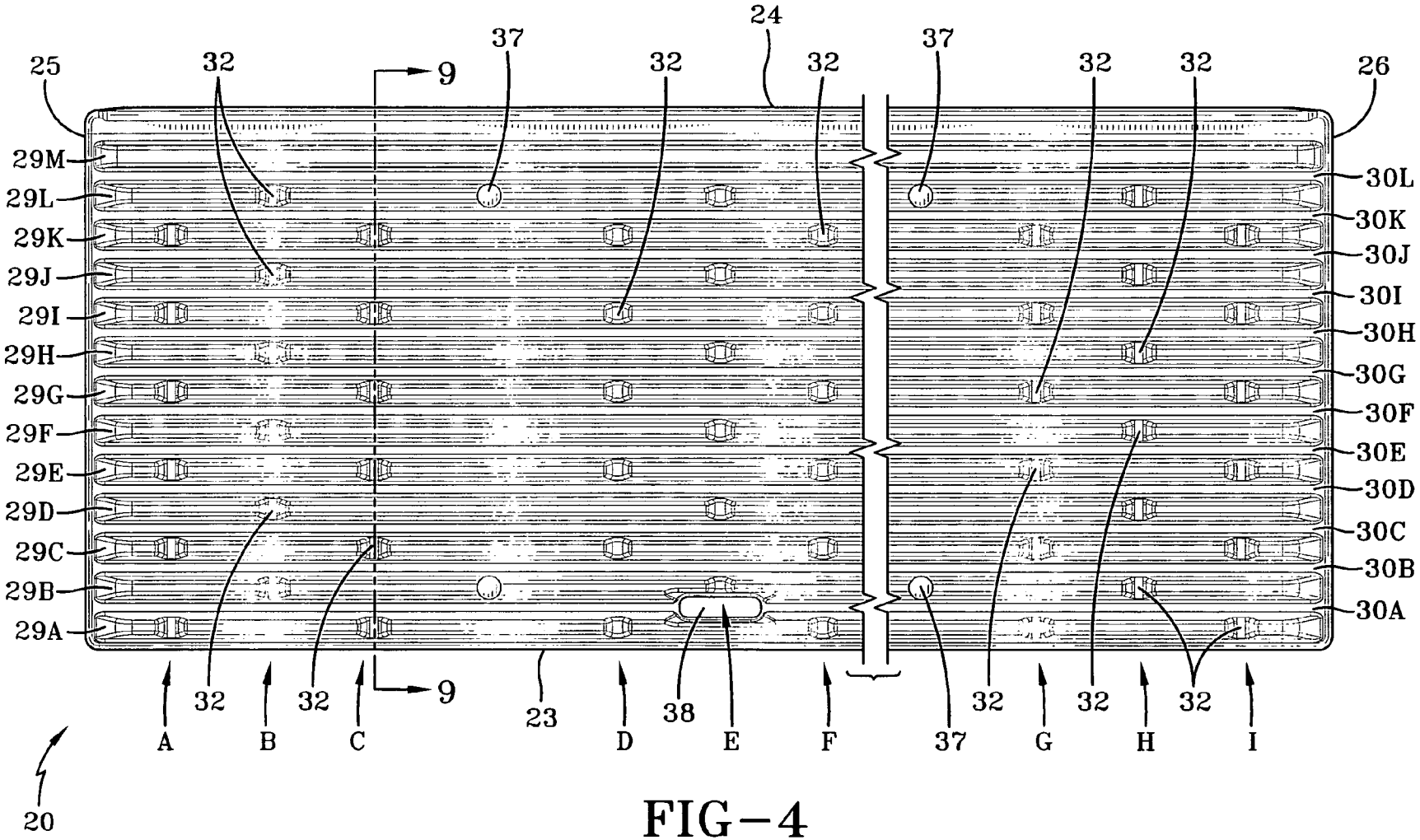
FIG. 4 is an elevational view of the surface of the separator pad shown in FIG. 2.
Figure 5:
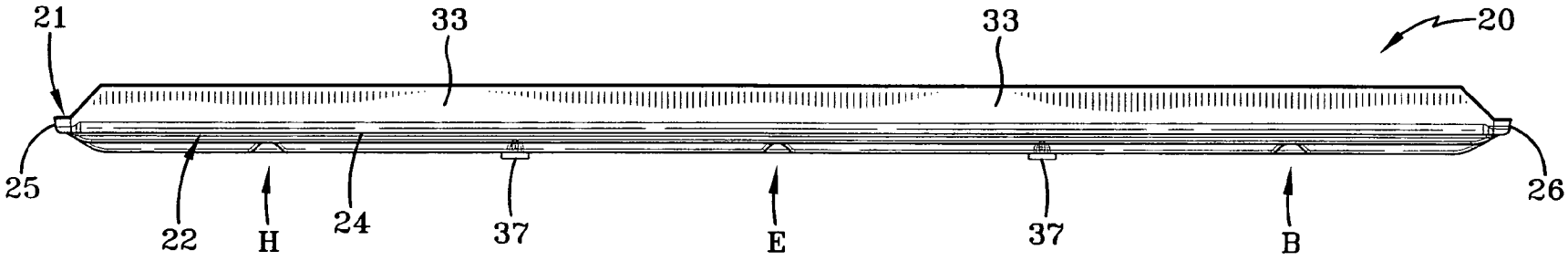
FIG. 5 is an elevational view of one longitudinal edge of the separator pad.
Figure 6:
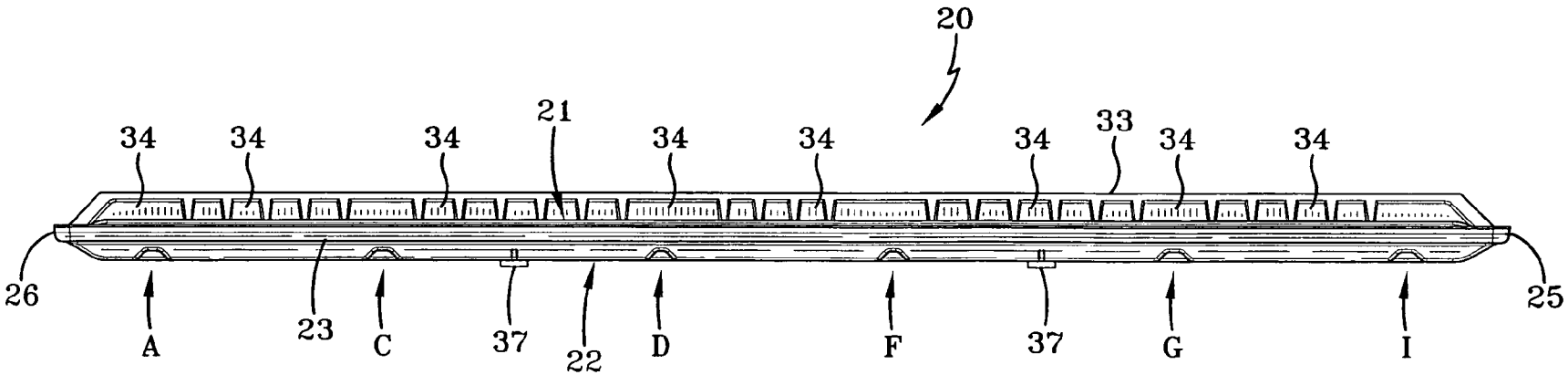
FIG. 6 is an elevational view of the longitudinal edge of the separator pad opposed to the edge shown in FIG. 5.
Figure 7:
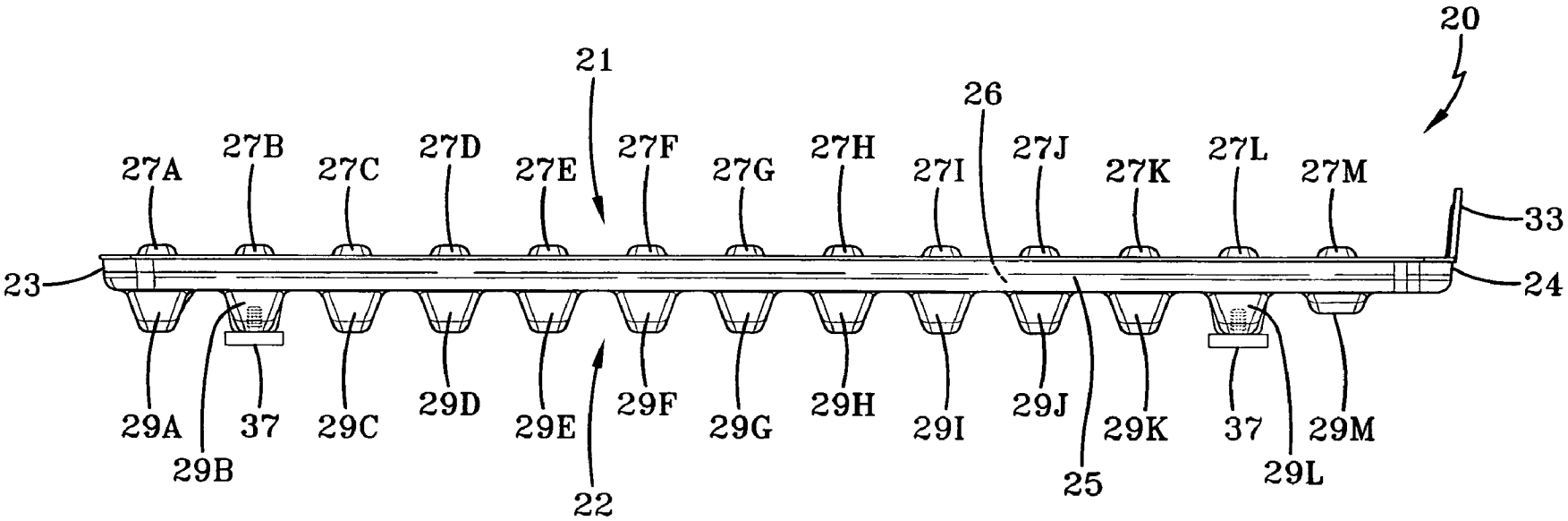
FIG. 7 is an elevational view of a lateral edge of the separator pad.

Sheet surface 22 includes nine longitudinally spaced rows A-I of notches 32 which are positioned in all ribs 29 except rib 29M. Rib 29M is not as deep as ribs 29A-L and, in fact, is at the approximate height of notches 32 in ribs 29A-L. Each row A-I includes six notches 32 and the notches are grouped in clusters of three rows each, rows A-C, rows D-F, and rows G-I. As best seen in FIG. 4, each cluster of rows includes an identical pattern of notches 32. Thus, in A-C cluster of rows, in rows A and C notches 32 are aligned in alternate ribs 29A, 29C, 29E, 29G, 29I, and 29K. In row B, notches 32 are staggered from those in rows A and C and thus are aligned in alternate ribs 29B, 29D, 29F, 29H, 29J, and 29L. In the D-F cluster of rows, in rows D and F notches 32 as aligned in alternate ribs 29A, 29C, 29E, 29G, 29I, and 29K and in row E, notches 32 are staggered from those in rows D and I and are thus aligned in alternate ribs 29B, 29D, 29F, 29H, 29J, and 29L. Similarly in the G-I cluster of rows, in rows G and I notches 32 are aligned in alternate ribs 29A, 29C, 29E, 29G, 29I, and 29K and in row H, notches 32 are staggered from those in rows G and I and are thus aligned in alternate ribs 29B, 29D, 29F, 29H, 29J, and 29L.

Figure 8:
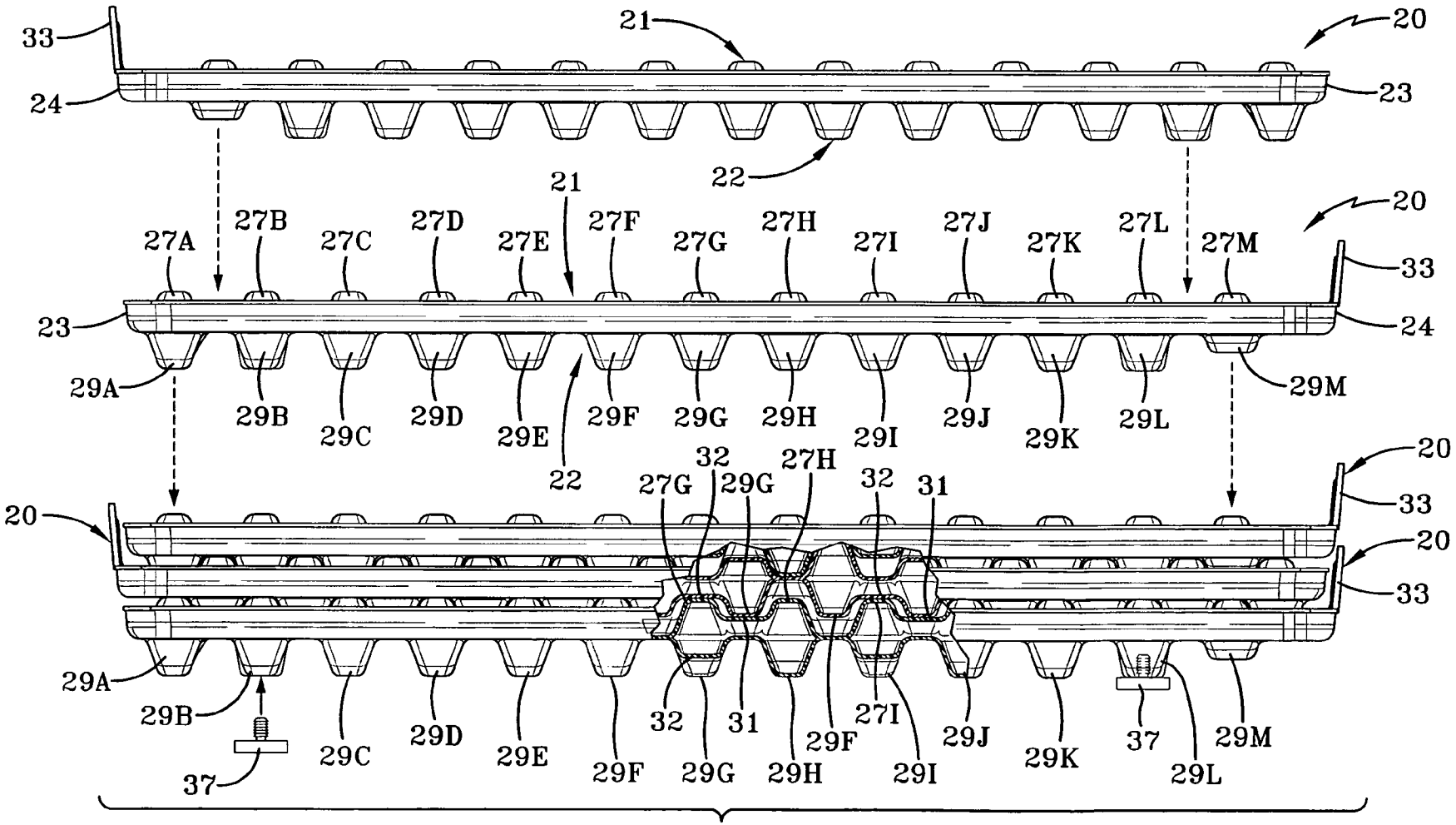
FIG. 8 is an enlarged elevational/sectional view showing the manner in which separator pads of the present invention may nest with each other when stacked.

By virtue of this configuration, a plurality of separator pads 20 can be nested within each other for compact shipment from the factory to the user. Such nesting is shown in FIG. 8 and when in this condition, all lugs 31 are positioned in their mating notches 32. For example, the lug 31 in row A between ribs 27A and 27B is positioned in the notch in rib 29K in row I. Similarly, the lug 31 in row A between ribs 27K and 27L is positioned in the notch 32 in rib 29A in row I. The other notches 32 and ribs 31 are likewise mated so that there are, in total, fifty-four rib/notch connections when pads 20 are nested.

Figure 9:
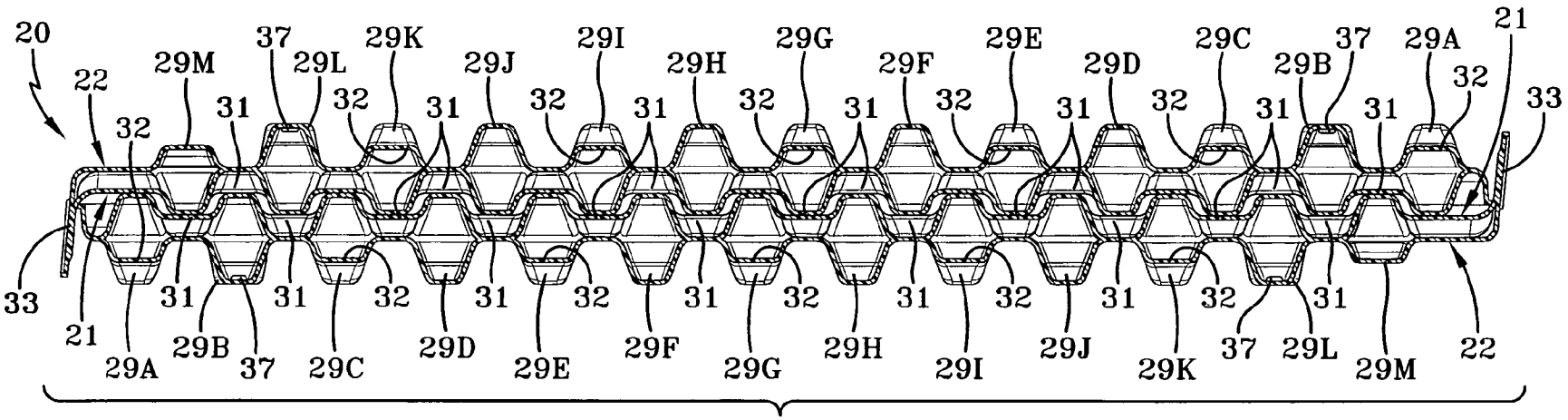
FIG. 9 is an enlarged sectional view showing the manner in which two separator pads of the present invention may be positioned adjacent to each other to form a composite pad of greater thickness.

The unique configuration of pads 10 not only permits the nesting thereof, if desired, but also the orientation of the pads 20 may be changed so that two pads could be placed together, without being nested as described above, but so as to provide a thicker composite pad to provide an overall higher stiffness and rigidity, if desired. Such is shown in FIG. 9 wherein it can be seen that as opposed to the nested orientation of FIG. 8, the pads have been reoriented relative to each other to create a combined pad of almost double thickness. In this configuration, the top sheet surfaces 21 are adjacent to each other and the ribs 27 of surface 21 of one pad 20 are within the recesses 28 of surface 21 of the other pad.

While small lips are formed on edges 23, 25, and 26 as previously described, edge 24 is formed with a flange 33 extending substantially upwardly laterally from surface 21. As will hereinafter be described in more detail, flange 33 assists pad 20 from sliding when in use. Flange 33 is provided with a plurality of ribs 34 to strengthen the same while permitting it to be thin. Moreover, a plurality of longitudinally spaced ribs 35 are provided between ribs 27M and flange 33 to further strengthen that area of pad 20.

During the thermoforming process, small blow pin holes 36 are formed in surface 22. These holes 36 may be conveniently plugged with rubber feet 37 so that when a pad 20 is resting on surface 22, as when nested for shipping, pad 20 will not skid. In addition, a handle aperture 38 is also formed in sheet surfaces 21 and 22 to permit pad 20 to be easily transported with one hand.

Figure 10:
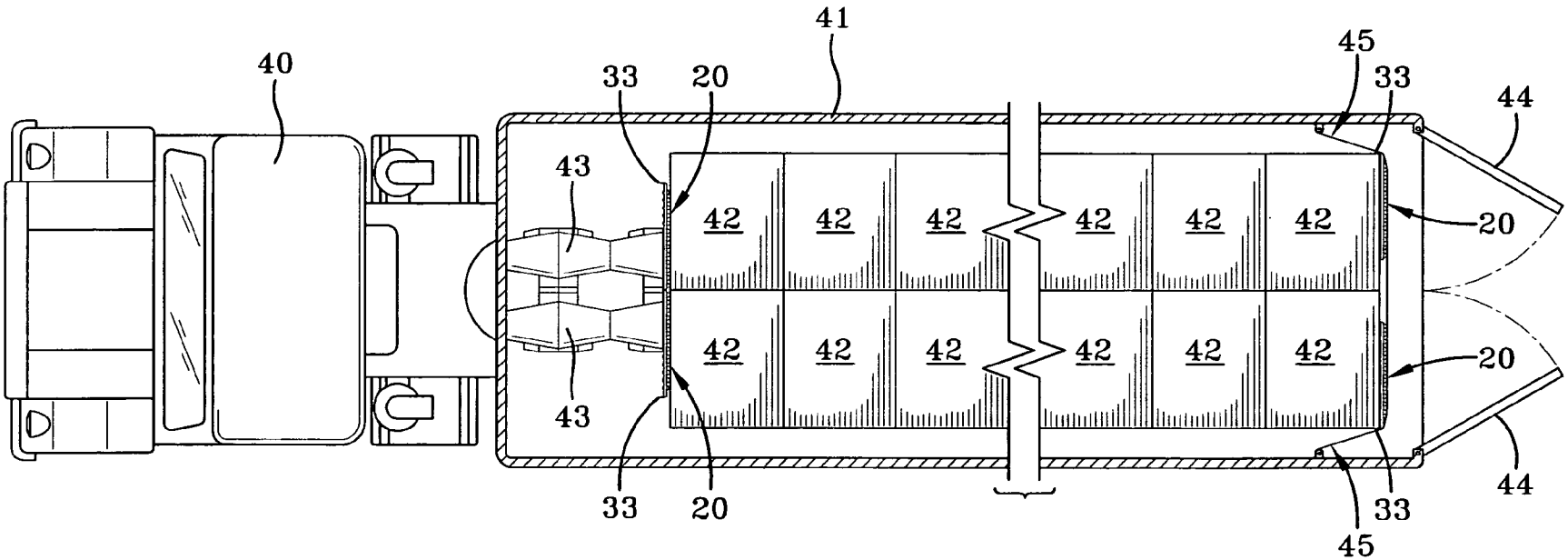
FIG. 10 is a schematic top view of a tractor trailer truck having a load and showing the separator pads in use.

One typical use of pads 20 is shown in FIG. 10. There a truck having a cab 40 and a trailer 41 is schematically shown as carrying a load consisting of a plurality of containers 42. As previously described, quite often a trailer cannot be completely filled with a load because it would then be overweight. As such, the trailer 41, only partially filled with a load of containers 42, must be provided with some type of positioning devices to restrain the load from shifting. Pads 20 serve that and other purposes.

In a typical situation shown in FIG. 10, one or more conventional bulkhead spacing devices 43 may be provided to space the load from the front of the trailer and otherwise use up space that is unwanted for cargo. One or more pads 20 (two shown in FIG. 10) are then positioned on edge 26 so as to extend vertically above the bulkhead spacers 43. Such prevents the containers 42 of the load from moving over the top of bulkhead spacers 43 and falling into the unwanted cargo space.

Two pads 20 may also be positioned at the other end of the load near the rear end of the trailer 41, at doors 44. These pads 20 are best positioned so that their flanges 33 extend along the sides of the rearmost containers 42. As such, flanges 33 prevent the pads 20 at the back of the trailer 41 from sliding toward each other. In addition, pads 20 at the rear of the trailer 41 are maintained snugly against the load by a conventional tie down rope system 45 which extends from one side of the trailer 41 around pads 20 and to the other side of the trailer 41. In so doing, flanges 33 also present a good, smooth surface on which to stretch the tie down system 45 and prevent compression restraint damage to the edges of the load.

In view of the forgoing, it should be evident that a separator pad made as described herein accomplishes the objects of the invention and substantially improves the art.

What is claimed is:

1. A pad for separating or restraining cargo comprising a first sheet surface, a second sheet surface opposed to said first sheet surface, a plurality of spaced ribs on said first sheet surface thereby forming a plurality of recesses therebetween, a pattern of lugs formed on said first sheet surface in said recesses, and a like pattern of notches formed on said second sheet surface such that in one orientation the pad may nest with a like pad by positioning the lugs of the pad in the notches of the like pad, and by changing the orientation of the pad relative to the like pad, the pad and the like pad will not nest.

2. The pad of claim 1 wherein the changed orientation of the pad with the like pad is such that said ribs of said first sheet surface of the pad are positioned in the recesses of the first sheet surface of the like pad.

3. The pad of claim 1 further comprising a plurality of spaced ribs on said second sheet surface thereby forming a plurality of recesses therebetween, said pattern of notches being formed in said ribs of said second sheet surface.

4. The pad of claim 3 wherein the pattern of lugs includes three clusters of lugs, each cluster having three rows of lugs including a center row of lugs, the lugs of the center row being positioned in different recesses of said first sheet surface than the lugs of the other two rows of lugs.

5. The pad of claim 4 wherein the pattern of notches includes three clusters of notches, each cluster having three rows of notches including a center row of notches, the notches of the center row of said notches being positioned on different ribs of said second sheet surface than the notches of the other two rows of notches.

6. The pad of claim 1 further comprising a flange extending generally laterally outwardly from one edge of said first sheet surface.

7. The pad of claim 1 further comprising a plurality of feet carried by said second sheet surface and a handle opening extending through said first and second sheet surfaces.

* * * * *